US006418819B1

(12) United States Patent
Kuo

(10) Patent No.: US 6,418,819 B1
(45) Date of Patent: Jul. 16, 2002

(54) WRENCH

(75) Inventor: Teng Hsien Kuo, Taipei Hsien (TW)

(73) Assignee: King Lugger Inc., Taipei Hsien (TW)

( * ) Notice: Subject to any disclaimer, the term of this patent is extended or adjusted under 35 U.S.C. 154(b) by 0 days.

(21) Appl. No.: 09/986,700

(22) Filed: Nov. 9, 2001

(51) Int. Cl.[7] ..... B25B 13/16
(52) U.S. Cl. ..... 81/165; 81/126; 81/157
(58) Field of Search ..... 81/165, 126, 157, 81/158, 133

(56) References Cited

U.S. PATENT DOCUMENTS

| | | | | | |
|---|---|---|---|---|---|
| 903,205 | A | * | 11/1908 | Larson | 81/165 |
| 2,069,842 | A | * | 2/1937 | Nielsen | 81/165 |
| 2,562,060 | A | * | 7/1951 | Pehrsson | 81/165 |
| 2,970,502 | A | * | 2/1961 | Nordgren | 81/165 |
| 3,926,077 | A | * | 12/1975 | Nordgren | 81/165 |
| 5,297,459 | A | * | 3/1994 | Stojanowski | 81/165 |
| 5,890,404 | A | * | 4/1999 | Stojanowski | 81/165 |
| 5,941,142 | A | * | 8/1999 | Janson | 81/165 |
| 6,089,129 | A | * | 7/2000 | Huang | 81/133 |
| 6,336,384 | B1 | * | 1/2002 | Huang | 81/165 |

FOREIGN PATENT DOCUMENTS

| | | |
|---|---|---|
| TW | 76209415 | 9/1987 |

* cited by examiner

*Primary Examiner*—James G. Smith
*Assistant Examiner*—Hadi Shakeri
(74) *Attorney, Agent, or Firm*—Rabin & Berdo, P.C.

(57) ABSTRACT

A wrench includes a handle, a first jaw block pivotally connected a head of the handle, a second jaw block movably connected to the first jaw block to define a variable clamp space between them, and a rotating unit mounted on the first jaw block for adjusting an openness of the clamp space. When using the wrench to tighten or loosen a hex bolt to a certain degree, a user needs only to pull the handle in a direction opposite to that in which a force is applied on the handle to tighten or loosen the hex bolt, so that the clamp space on the first jaw block is caused to instantaneously slip and turn relative to the clamped hex bolt, allowing the user to apply a force on the handle again without the need of repeatedly removing and replacing the wrench from and onto the hex bolt.

4 Claims, 7 Drawing Sheets

WRENCH

FIELD OF THE INVENTION

The present invention relates to a wrench, and more particularly to a wrench that enables tightening and loosening of a hex bolt in only one continuous operation without the need of repeated removing and replacing of the wrench from and onto the hex bolt.

BACKGROUND OF THE INVENTION

When using a conventional wrench to tighten or loosen a hex bolt or any tube, post, bar, etc. having a polygonal cross section, a user needs to repeatedly turn the wrench, removing and replacing the wrench from and onto the hex bolt or the polygonal tube, post or bar, and turning the wrench again. These repeated movements are, of course, very bothersome to the user.

Taiwan Patent Application No. 76209415 entitled "Quick Wrench with Adjustable Clamp Space" discloses a wrench having a handle, and a movable jaw block pivotally connected to an end of the handle via a movable shaft. The movable jaw block is manually displaced and returnable to its original position via a return spring. When a user uses the wrench to tighten or loosen, for example, a hex bolt to a certain degree and has to continue the tightening or loosening movement, he or she may use, for example, a thumb to depress a rear end of the movable jaw block to release the jaw block from clamping the hex bolt. At this point, the user may lift the handle of the wrench to a proper position and then release the movable jaw block to restore its clamping state, and then turn the handle again to tighten or loosen the hex bolt further.

With the wrench disclosed in Taiwan Patent Application No. 76209415, the user still needs an additional movement to depress the movable jaw block to release the same from a clamping state, instead of manipulating the handle in one continuous movement to complete the tightening or loosening of the hex bolt. In other words, the movable jaw block must be repeatedly depressed and released for the user to complete the tightening or loosening of the hex bolt with the wrench in a manner close to the desired one-movement manipulation. As mentioned in the Quick Wrench with Adjustable Clamp Space disclosed in Taiwan Patent Application No. 76209415, the movable jaw block is repeatedly depressed and released to change the clamp space, so that the wrench could be continuously manipulated to tighten or loosen the hex bolt. For users, such repeated depressing and releasing of the movable jaw block still causes considerable inconvenience to them.

SUMMARY OF THE INVENTION

It is therefore a primary object of the present invention to provide an improved wrench that enables a user to tighten or loosen, for example, a hex bolt in one continuous movement without the need of removing and replacing the wrench from and onto the hex bolt for a next turning of the wrench to tighten or loosen the hex bolt further.

To achieve the above and other objects, the wrench of the present invention mainly includes a handle having an expanded head portion formed into two spaced and parallel plates to define a clearance therebetween, a first jaw block having a rearward extended sectorial portion pivotally connected to the expanded head portion of the handle to either locate in or partially move out of the clearance, a second jaw block movably connected to the first jaw block to define a variable clamp space between them, and a rotating unit mounted on the first jaw block for adjusting an openness of the clamp space. A slip stopper is provided in the expanded head portion of the handle and adapted to move to a position that allows the first jaw block to elastically move out of or locate in the clearance.

When using the wrench of the present invention to tighten or loosen, for example, a hex bolt to a certain degree, a user needs only to pull the handle in a direction opposite to that in which a force is applied on the handle to tighten or loosen the hex bolt, so that the clamp space on the first jaw block is caused to instantaneously slip and turn relative to the clamped hex bolt, allowing the user to apply a force on the handle again without the need of repeatedly removing and replacing the wrench from and onto the hex bolt.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
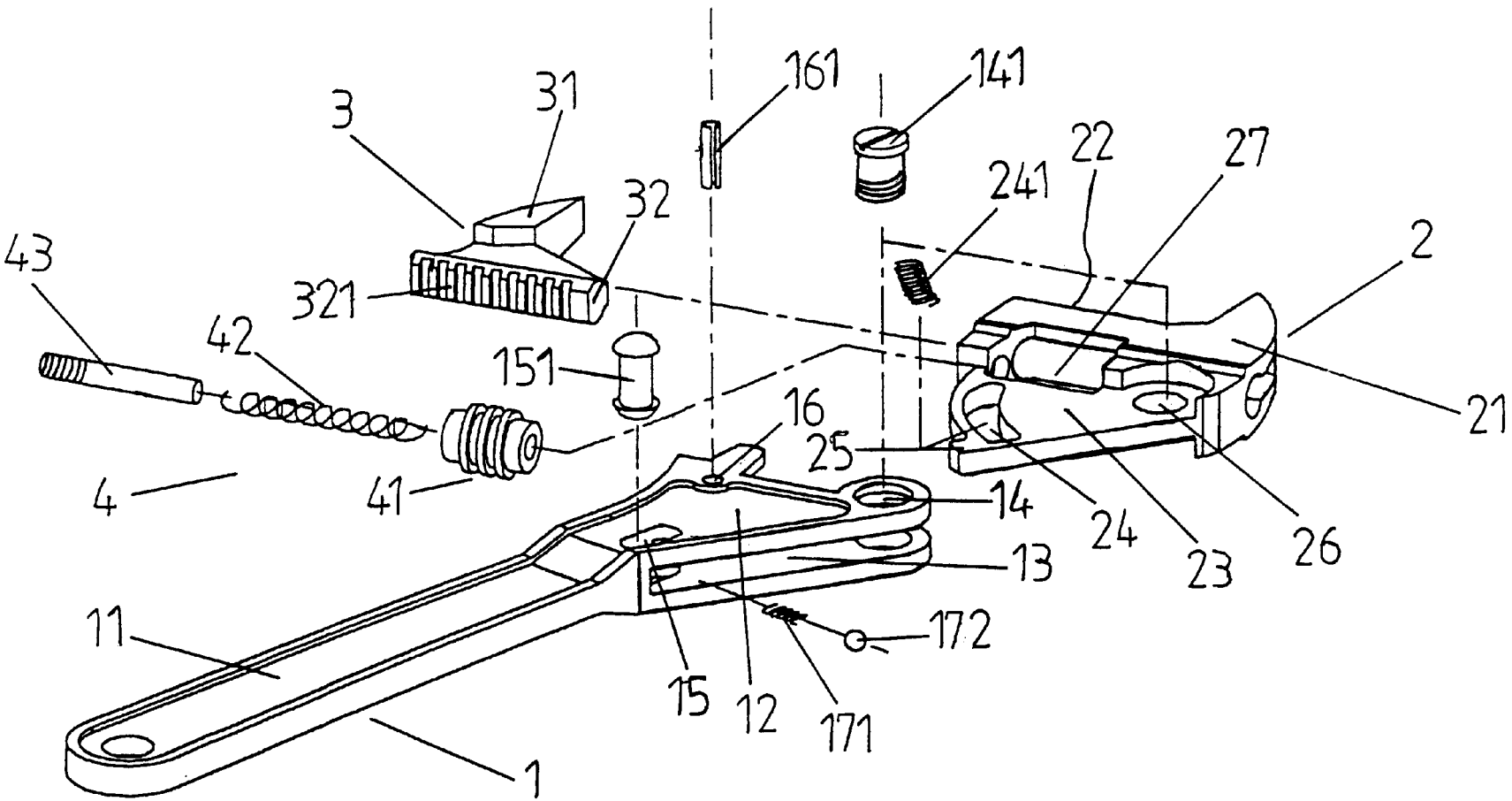
FIG. 1 is an exploded perspective view of a wrench according to the present invention.

Please refer to FIG. 1 that is an exploded perspective view of a wrench according to the present invention. As shown, the wrench mainly includes a handle 1 which a user grips to manipulate the wrench; a first jaw block 2 movably connected to a front end of the handle 1; a second jaw block 3 movably connected to the first jaw block 2 to define a variable clamp space 311 (see FIG. 2) between them for holding, for example, a hex bolt 5; and a rotating unit 4 for controlling a translational movement of the second jaw block 3 relative to the first jaw block 2.

Figure 2A:
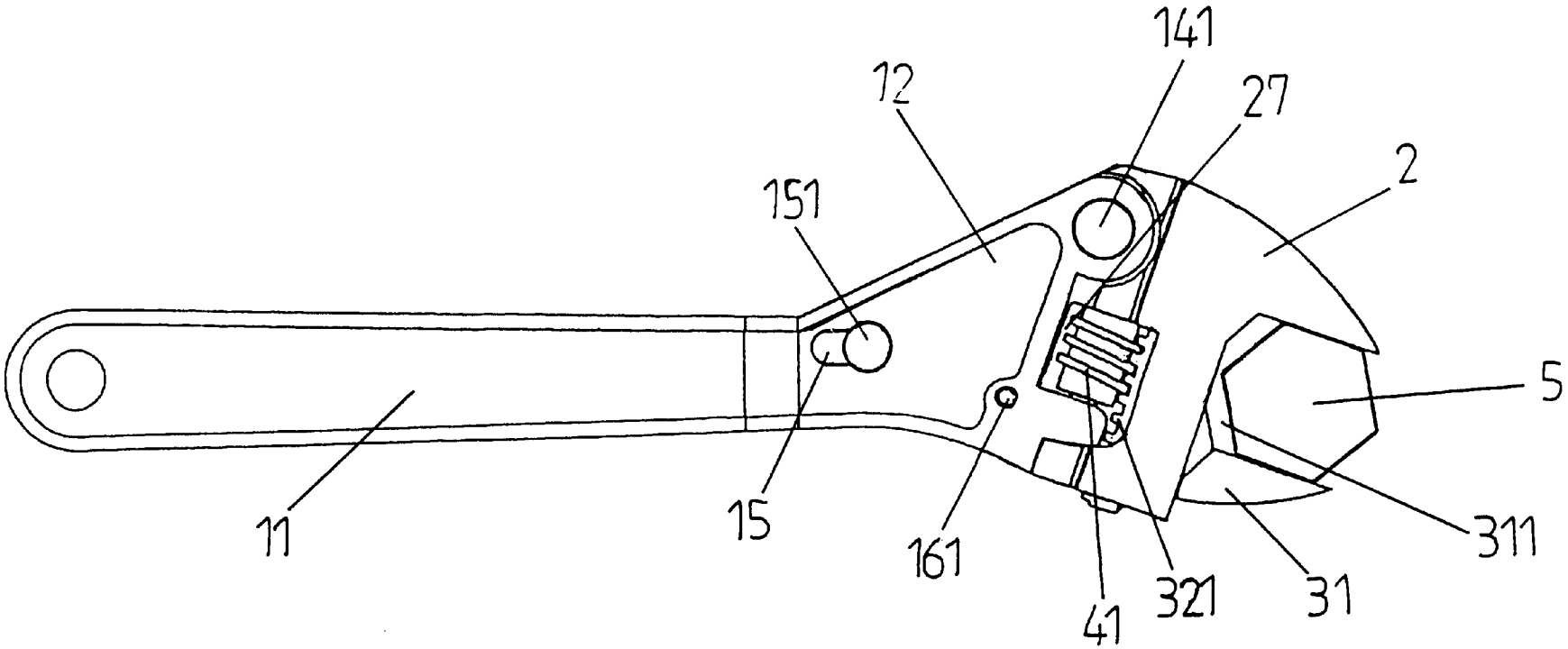
FIG. 2A is an assembled side view of the wrench of FIG. 1 with a slip stopper thereof being pushed forward into a front position.
Figure 2B:
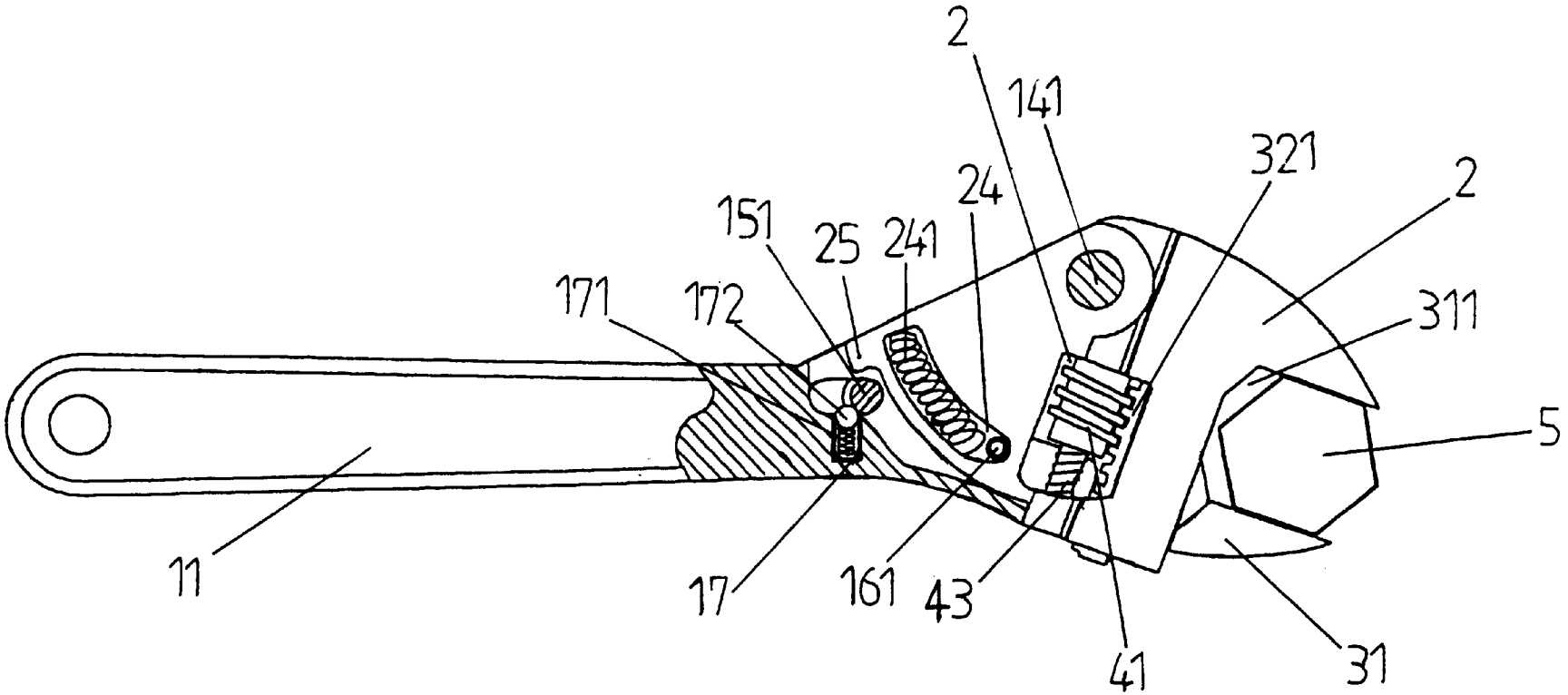
FIG. 2B is a partially sectioned view of FIG. 2A.

Please refer to FIGS. 1, 2A and 2B at the same time. The handle 1 includes a rear grip portion 11 which a user grips to manipulate the wrench, and a forward expanded head portion. The expanded head portion of the handle 1 is formed into two spaced and parallel plates 12 to define a clearance 13 between the plates 12. The expanded head portion of the handle 1 is provided at a rear end with an axially extended long slip hole 15 that vertically extends through the two parallel plates 12 for a slip stopper 151 to mount therein and slip between a front end and a rear end of the long slip hole 15. The slip hole 15 is provided at one longitudinal wall with a recess 17 (see FIG. 2B) for receiving a spring 171 and a ball 172 therein. When the slip stopper 151 is moved toward the front or the rear end of the long slip hole 15, it contacts with and pushes the ball 172 into the recess 17. When the slip stopper 151 passes the ball 172 and reaches the front or the rear end of the long slip hole 15, the spring 171 elastically pushes the ball 172 outward to confine the slip stopper 151 between the ball 172 and one end of the long slip hole 15. The expanded head portion of the handle 1 is also provided at a front corner with a shaft hole 14 vertically extended through the two plates 12, and at another front corner with a locating hole 16.

The first jaw block 2 includes a front edge having a fixed jaw 21 forwardly projected from an end thereof and a guide groove 22 extended along the rest portion of the front edge; a sectorial portion 23 backwardly extended from the front edge and adapted to be inserted into the clearance 13 between the two plates 12; and a translation hole 27 located at a joint of the sectorial portion 23 and the front edge, for receiving the rotating unit 4 therein. The sectorial portion 23 is provided along its arced edge with an arcuate guide slot 24 for receiving a spring 241 therein, at an outer end of the arced edge with a radially extended projection 25, and near an apex with a shaft hole 26 corresponding to the shaft hole 14 provided on the expanded head portion of the handle 1. When the sectorial portion 23 is inserted into the clearance 13 between the two plates 12, the shaft hole 26 is in alignment with the shaft hole 14 for a pivot shaft 141 to extend therethrough, and thereby allows the first jaw block 2 to pivotally turn about the pivot shaft 141 to move into or out of the clearance 13. When the sectorial portion 23 is located in the clearance 13, the locating hole 16 on the front corner of the expanded head portion of the handle 1 is in alignment with an inner end of the arcuate guide slot 24 on the sectorial portion 23. A stop pin 161 is inserted in the locating hole 16 to upward extend into the arcuate guide slot 24 and contact with an end of the spring 241 positioned in the guide slot 24. Another end of the spring 241 is located at an outer end of the arcuate guide slot 24 close to the projection 25.

When the first jaw block 2 is pivotally turned about the pivot shaft 141 to move into or out of the clearance 13 between the two plates 12, the projection 25 at the outer end of the sectorial portion 23 will pass the front end of the slip hole 15, as shown in FIG. 2B. When the sectorial portion 23 is received in the clearance 13 and the slip stopper 151 is pushed and retained to the front end of the slip hole 15 by the spring 171 and the ball 172, the projection 25 is stopped by the slip stopper 151 from moving and the sectorial portion 23 is therefore stopped from pivotally turning out of the clearance 13. That is, the first jaw block 2 is in an unmovable state relative to the handle 1.

The second jaw block 3 includes a movable jaw 31 located at a front side of the second jaw block 3 and a rib portion 32 transversely extended behind the movable jaw 31 to locate in the guide groove 22 at the front edge of the first jaw block 2. The clamp space 311 is located between the fixed jaw 21 and the movable jaw 31. The rib portion 32 is provide data rear wall surface with a plurality of teeth 321.

The rotating unit 4 includes an externally threaded bolt 41 that has a hollow body to define a central passage 411, and a guide bar 43 having a spring 42 put there around and being extended through the central passage 411 of the threaded bolt 41. The threaded bolt 41 is received in the translation hole 27 of the first jaw block 2 and is held therein by the guide bar 43 that is fixed at two ends to the translation hole 27. The threaded bolt 41 in the translation hole 27 meshes with the teeth 321 of the second jaw block 3 in the guide groove 22 of the first jaw block 2. By rotating the threaded bolt 41, the second jaw block 3, and accordingly the movable jaw 31, is caused to translate in the guide groove 22 through engagement of the bolt 41 with the teeth 321. The translation of the movable jaw 31 in the guide groove 22 changes an openness of the clamp space 311.

Figure 3A:
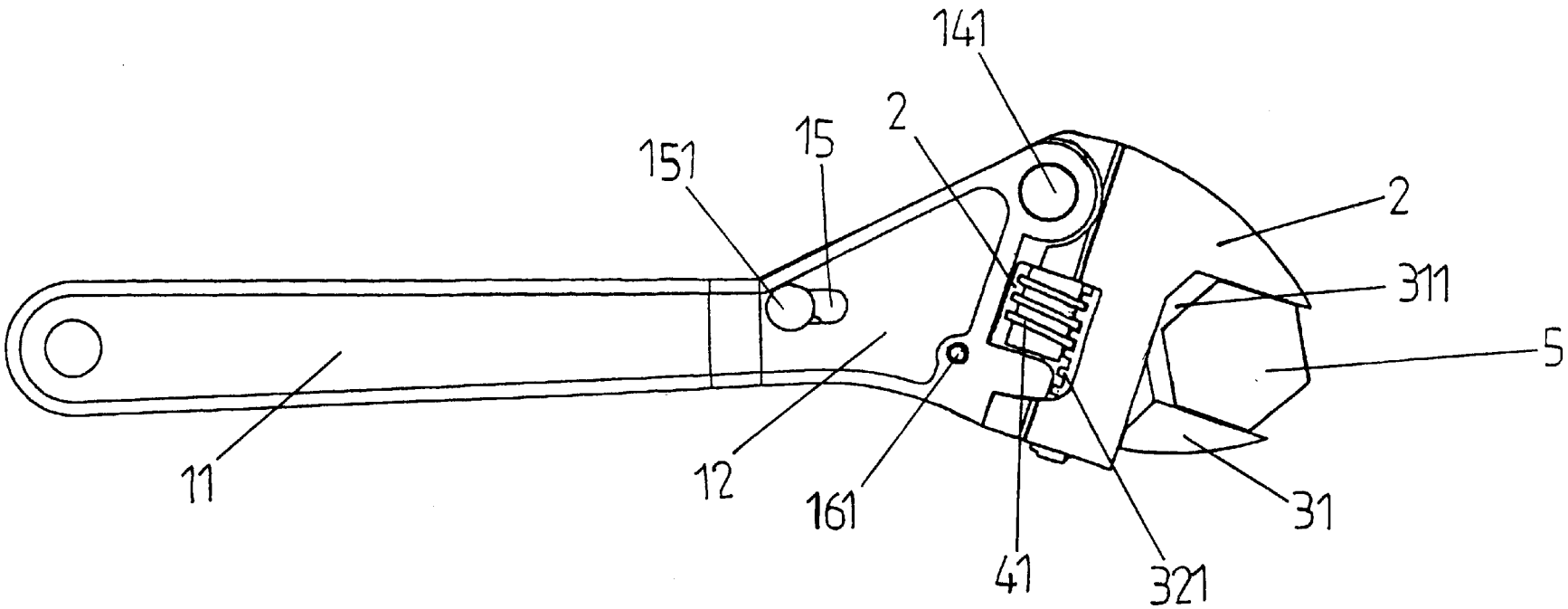
FIG. 3A is an assembled side view of the wrench of FIG. 1 with the slip stopper thereof being pushed backward into a rear position.
Figure 3B:
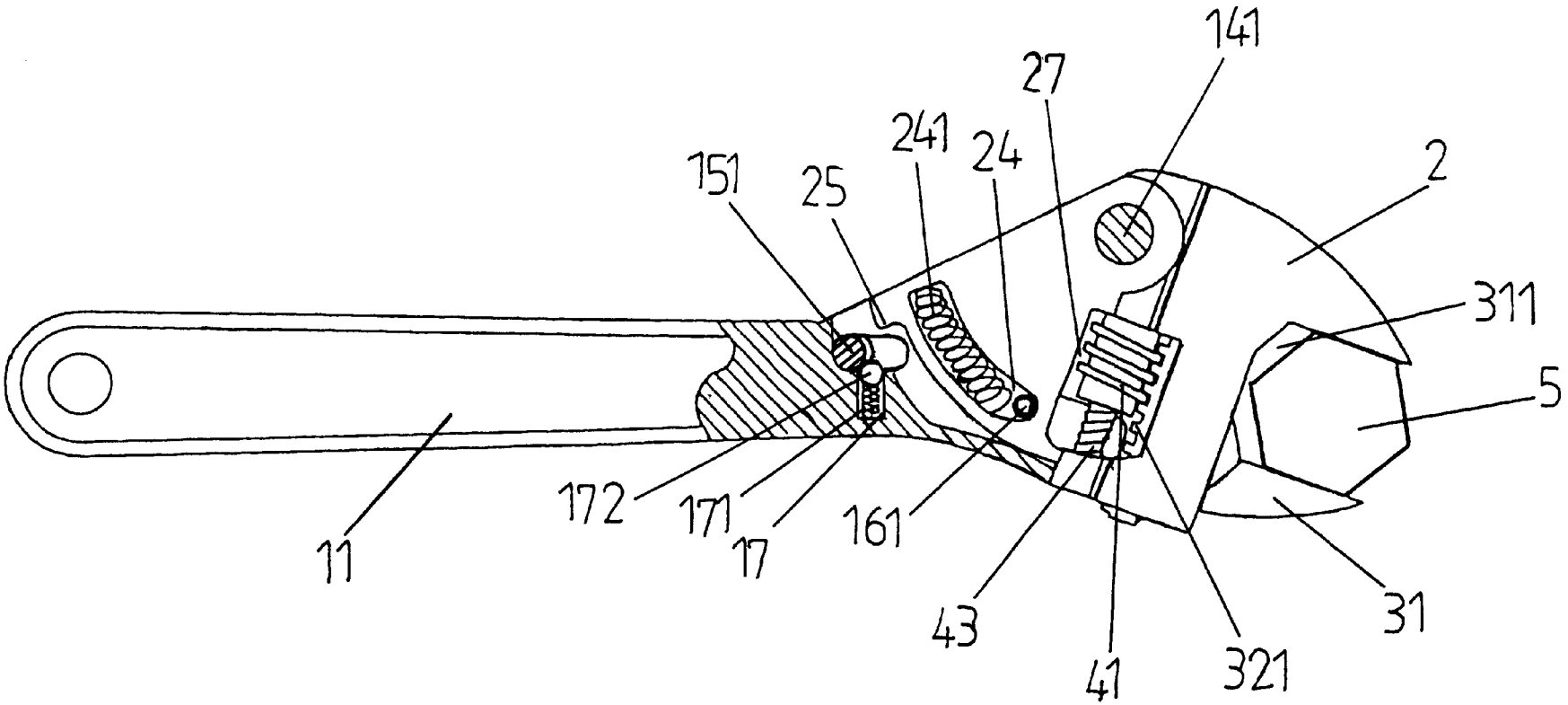
FIG. 3B is a partially sectioned view of FIG. 3A.

Please refer to FIGS. 3A and 3B. When a user wishes to tighten a hex bolt 5 with the wrench of the present invention in one single operation without the need of repeatedly removing and replacing the wrench from and onto the hex bolt 5, he or she needs only to push the slip stopper 151 rearward to locate the same in the rear end of the slip hole 15, so that the slip stopper 151 does not interfere with the projection 25 on the first jaw block 2.

Figure 4A:
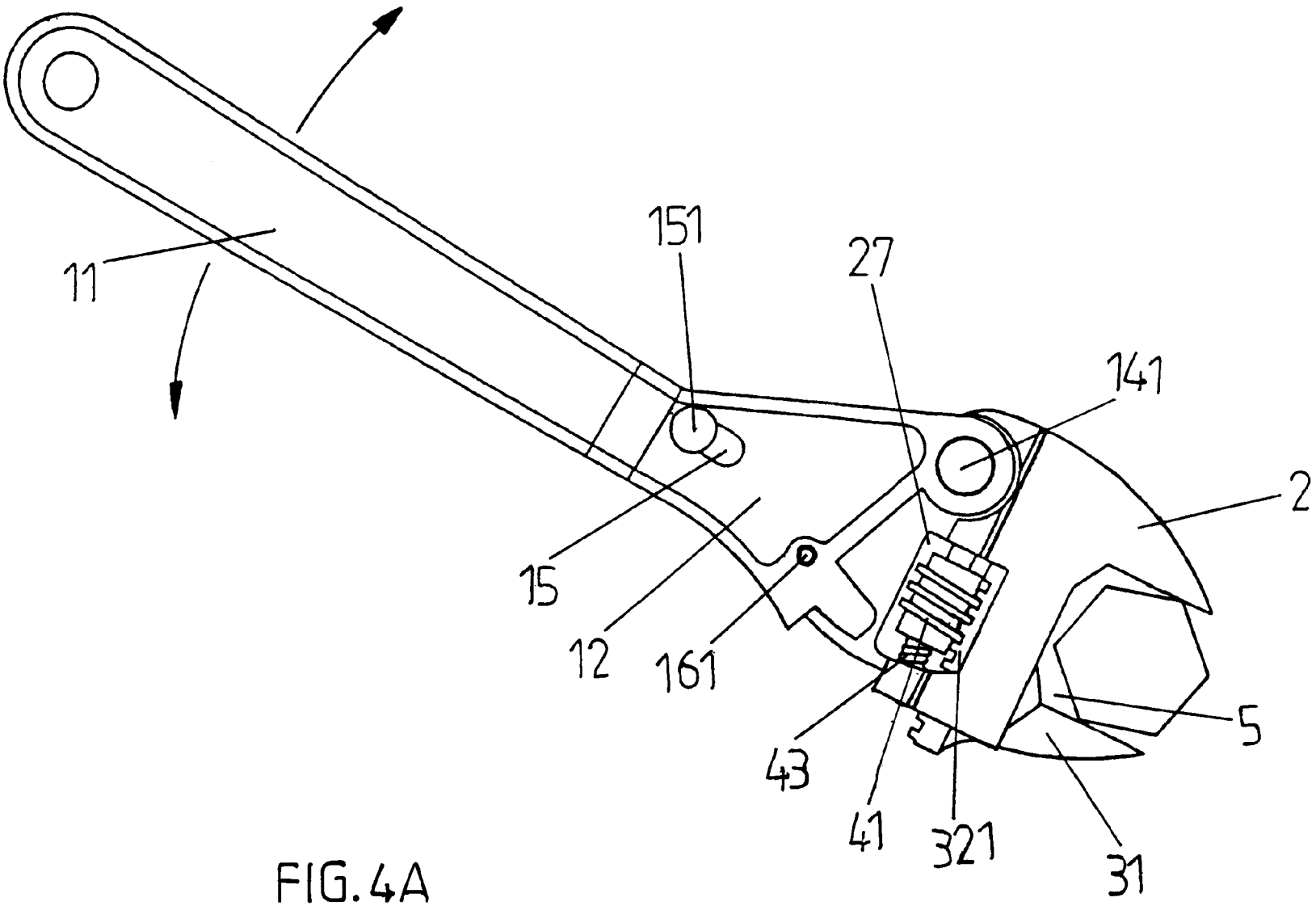
FIG. 4A shows a handle of the wrench of the present invention is pivotally lifted relative to a first jaw block connected thereto.
Figure 4B:
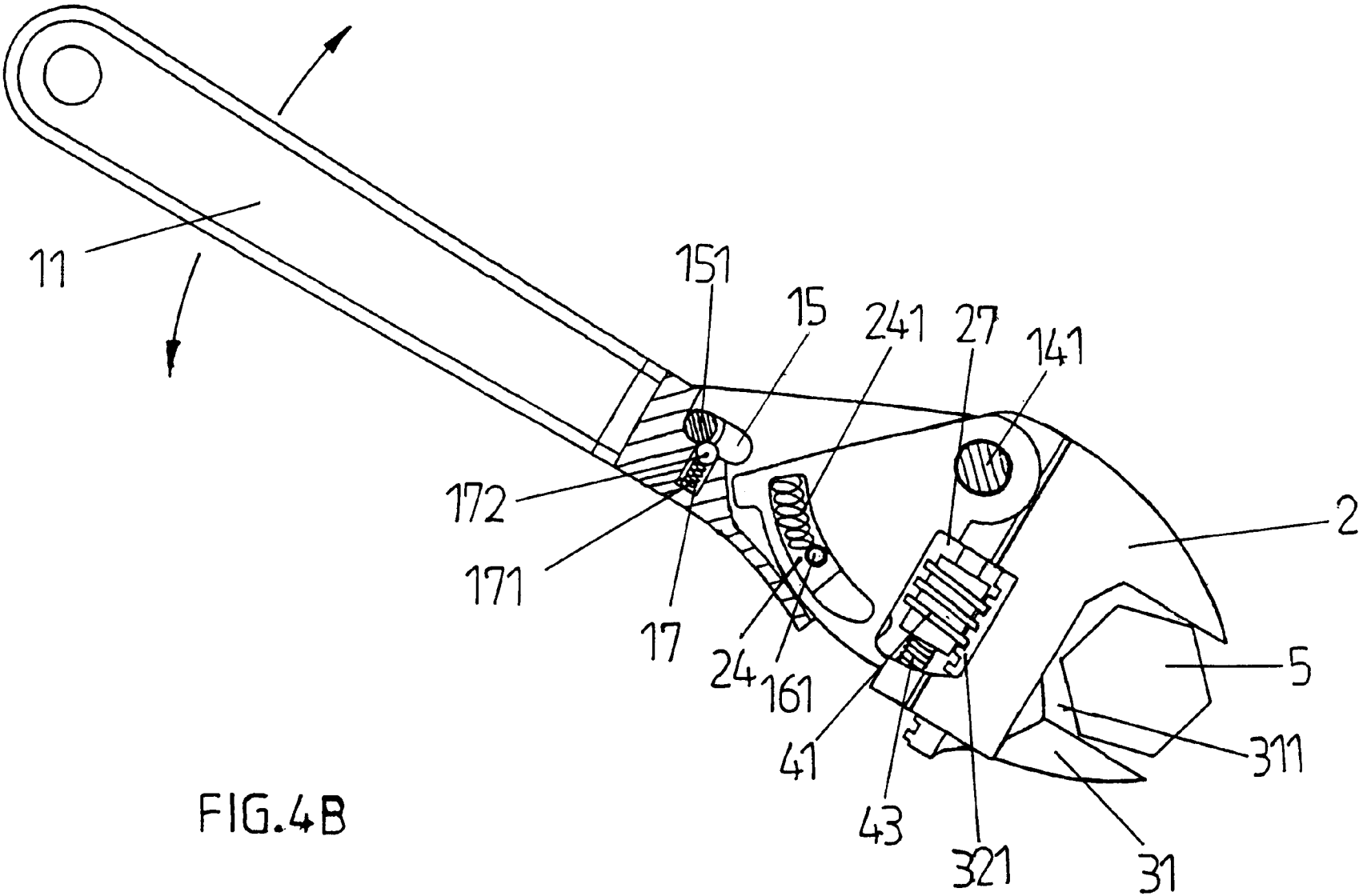
FIG. 4B is a partially sectioned view of FIG. 4B.

Please refer to FIGS. 4A and 4B. When the user tightens the hex bolt 5 with the wrench of the present invention having the slip stopper 151 pushed to the rear end of the slip hole 15, he or she needs only to turn the grip portion 11 of the handle 1 in one direction to loosen or tighten the bolt, and turn the grip portion 11 in the opposite direction to open the clamp space to allow the wrench to move relative to the bolt. With such actions since, the fixed jaw 21 of the first jaw block 2 has already firmly pressed against the hex bolt 5 that is held in the clamp space 311 between the fixed and the movable jaws 21, 31, the first jaw block 2 would not be rotated when the grip portion 11 is initially rotated. The grip portion 11 alone is turned about the pivot shaft 141 to move away from the first jaw block 2, allowing the latter to partially expose from the two plates 12. At this point, the spring 241 in the arcuate guide slot 24 of the first jaw block 2 is compressed due to the stop pin 161 located at one end of the spring 241. When the grip portion 11 is turned to a certain degree that would eventually force the first jaw block 2 to instantaneously slip and turn away from its original position of firm pressing against the hex bolt 5 while the openness of the clamp space 311 keeps unchanged, a restoring force of the compressed spring 241 would push the first jaw block 2 back into the clearance 13 between the two plates 12. In other words, when the wrench of the present invention is used to tighten or loosen a hex bolt 5, the user needs only to apply a downward force on the grip portion 11 of the handle 1 of the wrench to rotate the hex bolt 5, and then pull the same in a reverse direction to cause an instantaneous slip and turn of the clamp space 311 relative to the hex bolt 5 before applying force on the grip portion 11 again to tighten or loosen the hex bolt 5 further. The user does not need to repeatedly turn the wrench, remove the wrench from the hex bolt 5, replace the wrench onto the hex bolt 5, and turn the wrench again.

The user may also push the slip stopper 151 forward to locate the same in the front end of the slip hole 15 when the first jaw block 2 is received in the clearance 13 between the two plates 12 of the expanded head portion of the handle 1, so as to prevent the projection 25 of the first jaw block 2 from passing through the slip stopper 151 and the first jaw block 2 from pivotally turning about the pivot shaft 141. That is, the wrench of the present invention may be operated to tighten or loosen the hex bolt 5 just in the manner of manipulating a conventional wrench.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A wrench, comprising:

a handle having an expanded head portion formed into two spaced and parallel plates, said plates having a clearance defined therebetween;

a first jaw block pivotally connected to said expanded head portion to allow said first jaw block to move in and partially move out of the clearance;

a second jaw block movably connected to said first jaw block, said first and said second jaw blocks having a variable clamp space defined therebetween;

a rotating unit mounted onto said first jaw block for translating said second jaw block relative to said first jaw block, so as to adjust a size of the clamp space; and a slip stopper provided in said two plates, and being movable between two different positions to selectively allow and prohibit said first jaw block to pivotally turn in and out of the clearance;

wherein a rear end of said two plates is provided with an axially extended long slip hole, a longitudinal side of the slip hole being provided with a recess for receiving a spring and a ball therein, a region near a front corner of said two plates being provided with a shaft hole for a pivot shaft to extend therethrough that pivotally connects said first jaw block to said expanded head portion, and a region near another front corner of said two plates being provided with a locating hole.

2. The wrench as claimed in claim 1, wherein said first jaw block includes:

a front edge having a fixed jaw forwardly projecting from an end thereof and a guide groove extended along a remainder of the front edge for receiving said second jaw block therein, so that said second jaw block translates along said guide groove to define the variable clamp space between said second jaw block and said fixed jaw;

a sectorial portion rearwardly extending from the front edge and being locatable in the clearance between said two plates;

a translation hole formed along a joint of the front edge and the sectorial portion;

a projection radially extending from an outer end of an arced edge of the sectorial portion;

an arcuate guide slot provided along the arced edge of said sectorial portion;

a spring positioned in the arcuate guide slot with an end of the spring being close to said projection; and a further shaft hole provided near an apex of the sectorial portion corresponding to the shaft hole on the expanded head portion of said handle for said pivot shaft to extend therethrough and thereby pivotally connecting the sectorial portion to and between said two spaced plates;

said arcuate guide slot corresponding to said locating hole provided on said expanded head portion of said handle, such that a stop pin inserted into said locating hole upward extends into said arcuate guide slot to press against another end of said spring in said arcuate guide slot opposite to said projection.

3. The wrench as claimed in claim 2, wherein said second jaw lock includes a forwardly projecting movable jaw that together with said fixed jaw defines the variable clamp space; and a rib transversely extending behind said movable jaw movably located in the guide groove on said first jaw block; and said rib being provided at a rear wall with a plurality of teeth.

4. The wrench as claimed in claim 3, wherein said rotating unit includes an externally threaded hollow bolt rotatably mounted on a guide bar that has a spring put therearound, said guide bar being fixed on said first jaw block with said threaded bolt located in said translation hole to mesh with said teeth on said rib of said second jaw block, whereby when said threaded bolt is rotated, said second jaw block is brought to translate in said guide groove.

* * * * *